US007722033B2

(12) United States Patent
Matsumoto et al.

(10) Patent No.: US 7,722,033 B2
(45) Date of Patent: May 25, 2010

(54) SHEET FEEDING APPARATUS, AND RECORDING APPARATUS AND READING APPARATUS COMPRISING SAME

(75) Inventors: Toshiya Matsumoto, Yokohama (JP); Kazuo Ohyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 231 days.

(21) Appl. No.: 11/472,295

(22) Filed: Jun. 22, 2006

(65) Prior Publication Data

US 2007/0001382 A1 Jan. 4, 2007

(30) Foreign Application Priority Data

Jun. 30, 2005 (JP) ..... 2005-191102

(51) Int. Cl.
*B65H 1/00* (2006.01)
*G03G 15/00* (2006.01)

(52) U.S. Cl. ..... 271/162; 271/145; 399/110; 399/107

(58) Field of Classification Search ..... 271/162, 271/145, 171; 399/108, 110, 107
See application file for complete search history.

(56) References Cited

U.S. PATENT DOCUMENTS 5,085,422 A * 2/1992 Sagara ..... 271/162
5,114,133 A * 5/1992 Osada et al. ..... 271/22
5,238,235 A * 8/1993 Nitta et al. ..... 271/9.09
6,000,692 A * 12/1999 Lee ..... 271/248
6,053,493 A * 4/2000 Yokoyama et al. ..... 271/171
6,116,590 A * 9/2000 Yokoyama et al. ..... 271/171
6,942,211 B2 * 9/2005 Teo et al. ..... 271/145
2002/0063374 A1 * 5/2002 Takahashi ..... 271/10.01
2003/0116907 A1 * 6/2003 Pearce et al. ..... 271/145
2003/0178764 A1 * 9/2003 Hasegawa ..... 271/171
2005/0151315 A1 * 7/2005 Yokoi ..... 271/145
2006/0082044 A1 * 4/2006 Aida ..... 271/145
2006/0284363 A1 12/2006 Matsumoto et al. ..... 271/10.11

FOREIGN PATENT DOCUMENTS

JP 03095031 * 4/1991
JP 05278870 * 10/1993
JP 11-301045 11/1999

* cited by examiner

*Primary Examiner*—Patrick H Mackey
*Assistant Examiner*—Patrick Cicchino
(74) *Attorney, Agent, or Firm*—Fitzpatrick, Cella, Harper & Scinto

(57) ABSTRACT

A sheet feeding apparatus is provided that includes a sheet feeding tray 21 that can rotate to open and close; a sheet positioning portion 25*a* disposed in a sheet feeding portion such that it can contact against a side end of stacked sheets S; an edge limiting member 211 disposed in the sheet feeding tray such that it can contact against a side end of the sheets on a side that is further upstream than the sheet positioning portion; and a control unit that controls an inverted posture of the edge limiting member in response to an operation to open or close the sheet feeding tray; wherein the edge limiting member rises accompanying an operation to open the sheet feeding tray and the edge limiting member collapses accompanying an operation to close the sheet feeding tray.

12 Claims, 13 Drawing Sheets

SHEET FEEDING APPARATUS, AND RECORDING APPARATUS AND READING APPARATUS COMPRISING SAME

BACKGROUND OF THE INVENTION

1. Field of the Invention

The present invention relates to a sheet feeding apparatus equipped with a sheet feeding tray that can rotate to open or close, and a recording apparatus and an image reading apparatus equipped with the sheet feeding apparatus.

2. Description of the Related Art

In a recording apparatus that records an image on a recording medium or an image reading apparatus that scans an image from an original, a sheet feeding apparatus is used to feed a recording medium in sheet form or a sheet as an original to an image forming portion or reading portion of the like. Examples of a recording apparatus include a printer, a copier, a facsimile, and a multifunction device or system using these. Examples of an image reading apparatus include a scanner and a multifunction device or system using the scanner. In the present application, the term "image" is used in a broad sense to include characters, symbols, line drawings, patterns and the like.

A sheet feeding apparatus comprises a sheet feeding tray for stacking sheets. As described in Japanese Patent Application Laid-Open No. H11-301045, a sheet feeding apparatus is known in which a sheet feeding tray is mounted in a condition whereby it can open and close in a rotatable manner. FIG. 12 is an oblique perspective view of a recording apparatus equipped with the conventional sheet feeding apparatus that shows the sheet feeding tray in an open state. FIG. 13 is an oblique perspective view of the recording apparatus of FIG. 12 that shows the sheet feeding tray in a closed state. According to the sheet feeding apparatus having the sheet feeding tray that can rotate to open or close as shown in FIG. 12 and FIG. 13, closing a sheet feeding tray 101 to store it inside the apparatus enables space saving and enhancement of aesthetic characteristics, and reliability can also be improved as the inside of the apparatus is protected from dust and the like. Further, according to this sheet feeding apparatus, a side guide is provided in the main body and the sheet feeding tray 101, respectively, for regulating the position and inclination of sheets by contacting against the side edge of stacked sheets.

More specifically, on the main body side a side guide 102 is provided as a positioning member that positions sheets, in the width direction (direction parallel to the feeding plane and perpendicular to the feeding direction) by contacting against the side edge in the vicinity of the leading end of sheets that are stacked in the sheet feeding tray. At the top part of the sheet feeding tray 101 that is capable of rotating to open or close is provided a side guide 101*a* as an inclination limiting member that limits an inclination within the feeding plane of sheets by contacting against the side edge of stacked sheets at a position further upstream than the side guide on the main body side. When the sheet feeding tray is in a folded-up state, the side guide 101*a* is contained in a recess portion formed in the upper case of the sheet feeding apparatus. According to this sheet feeding apparatus, the skewing of sheets can be reduced while still allowing the sheet feeding tray to open and close in a rotatable manner.

However, in the above described conventional example, it is only possible to provide the inclination limiting member 101*a* in a limited area at the top part of the sheet feeding tray due to space concerns or the configurational relationship with other constituent members when the sheet feeding tray 101 is folded up. Thus, an inclination limiting effect can not be expected after the rear end of a sheet passes the inclination limiting member. Further, an inclination limiting effect can also not be expected in the case of a sheet whose rear edge does not reach the inclination limiting member because the dimensions of the sheet in the length direction are short. Consequently, the conventional technology attempts to equalize a resistance force or a sheet feeding force that act on a sheet while it is being fed by disposing a plurality of sheet feeding means and a plurality of separation means in the sheet width direction in a well balanced manner and making it possible for them to move in the sheet width direction, to thereby reduce skew feeding of sheets. In this case, the inclination limiting member 101*a* is used in an auxiliary manner.

Further, in a sheet feeding apparatus in which priority is given to simplification of the apparatus or weight reduction, simplification and weight reduction with respect to sheet feeding means or separation means has been attempted by imparting the principal feeding force to a sheet at a fixed position at one location that is nearer the positioning member than the center of the width direction of the sheet. According to this configuration, skewing of a sheet is liable to occur since the balance of the feeding force or resistance force in the width direction of a sheet is poor. In order to avoid this kind of problem, a large inclination limiting member is provided in the sheet feeding tray and a positioning member provided on the main body side is made larger to simultaneously exert an inclination limiting effect.

However, in a common sheet feeding apparatus, since a sheet bundle comprising a plurality of sheets is stacked in the sheet feeding tray and only the uppermost sheet thereof is separated and fed, it is necessary for the height of the above described positioning member or inclination limiting member to be at least greater than or equal to the thickness (stack height) of the bundle of sheets. Consequently, disadvantages have arisen such as it being spatially impossible to store or fold up the sheet feeding tray, or the number of sheets that can be stacked in the sheet feeding tray being reduced. Other disadvantages include the fact that the size of the sheet feeding apparatus becomes large when the sheet feeding tray is folded up and stored, and the size of the main body side of the sheet feeding apparatus increases. Furthermore, since a sheet feeding tray comprising the inclination limiting member is supported by an external cover, a position of the inclination limiting member with respect to the positioning member is positioned via a sheet feeding frame, the external cover and the sheet feeding tray. Therefore, the position deviation precision in the width direction of the sheet is low, and skewing of the sheet can not be adequately suppressed.

SUMMARY OF THE INVENTION

An object of the present invention is to provide a sheet feeding apparatus having a simple and small-sized configuration that can effectively prevent skewing of sheets to be fed from a sheet feeding tray.

Another object of the present invention is to provide a sheet feeding apparatus comprising a sheet feeding tray that can open and close around a shaft portion in a substantially horizontal direction that intersects with the feeding direction of sheets, the apparatus including a positioning portion that is disposed in a sheet feeding portion and that contacts against a side end of stacked sheets; a limiting member that is disposed in the sheet feeding tray and that limits a position of the side end of the sheets on a side that is further upstream than the positioning portion; and control means that controls a posture of the limiting member in response to operation to an open or close the sheet feeding tray; wherein the limiting member rises with respect to the sheet feeding tray in response to an operation to open the sheet feeding tray, and the limiting member collapses in response to an operation to close the sheet feeding tray.

DETAILED DESCRIPTION OF THE PREFERRED EMBODIMENTS

Figure 1:
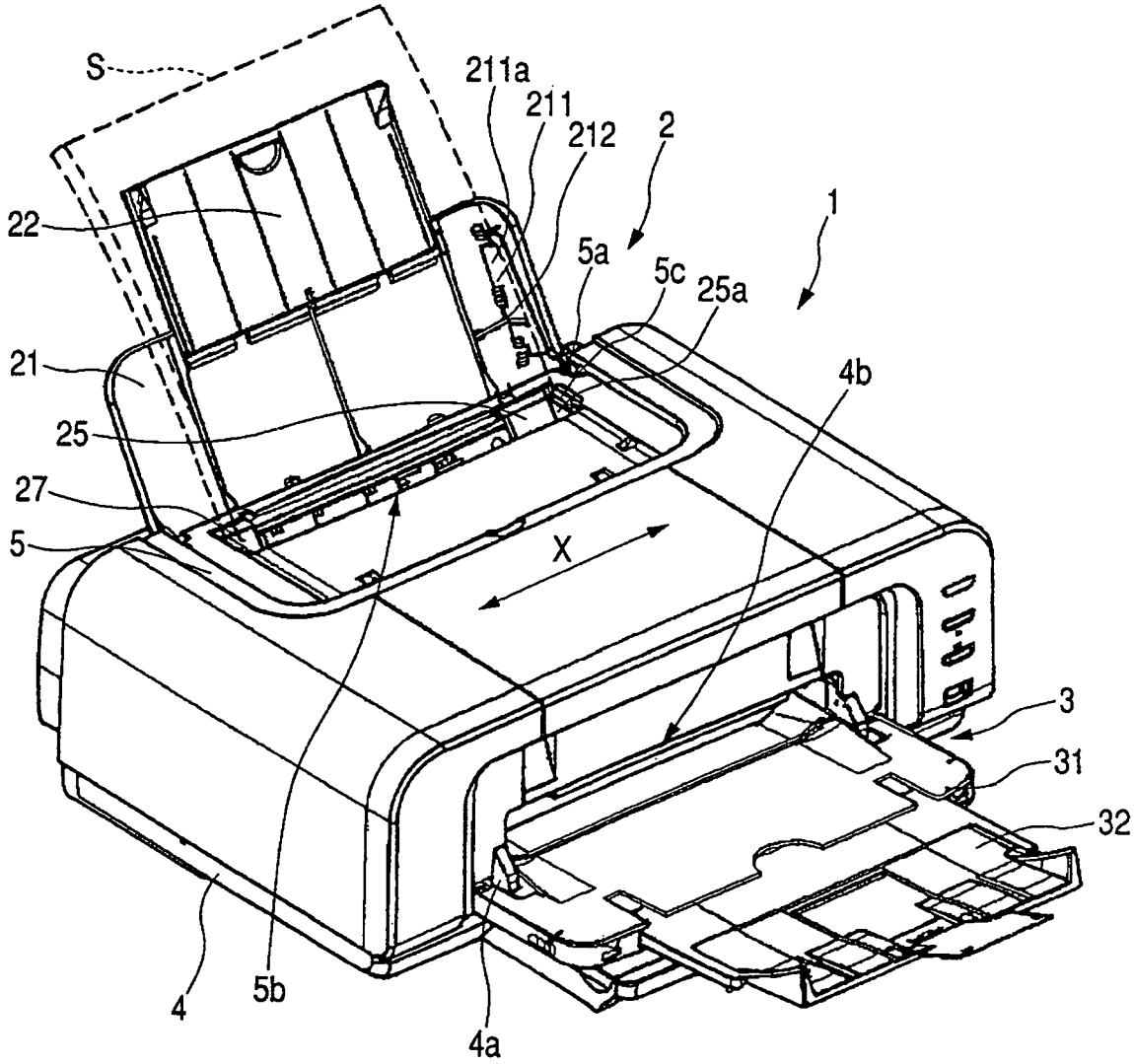
FIG. 1 is an oblique perspective view of a recording apparatus comprising a sheet feeding apparatus according to an embodiment of this invention when a sheet feeding tray and a discharge tray are open.
Figure 2:
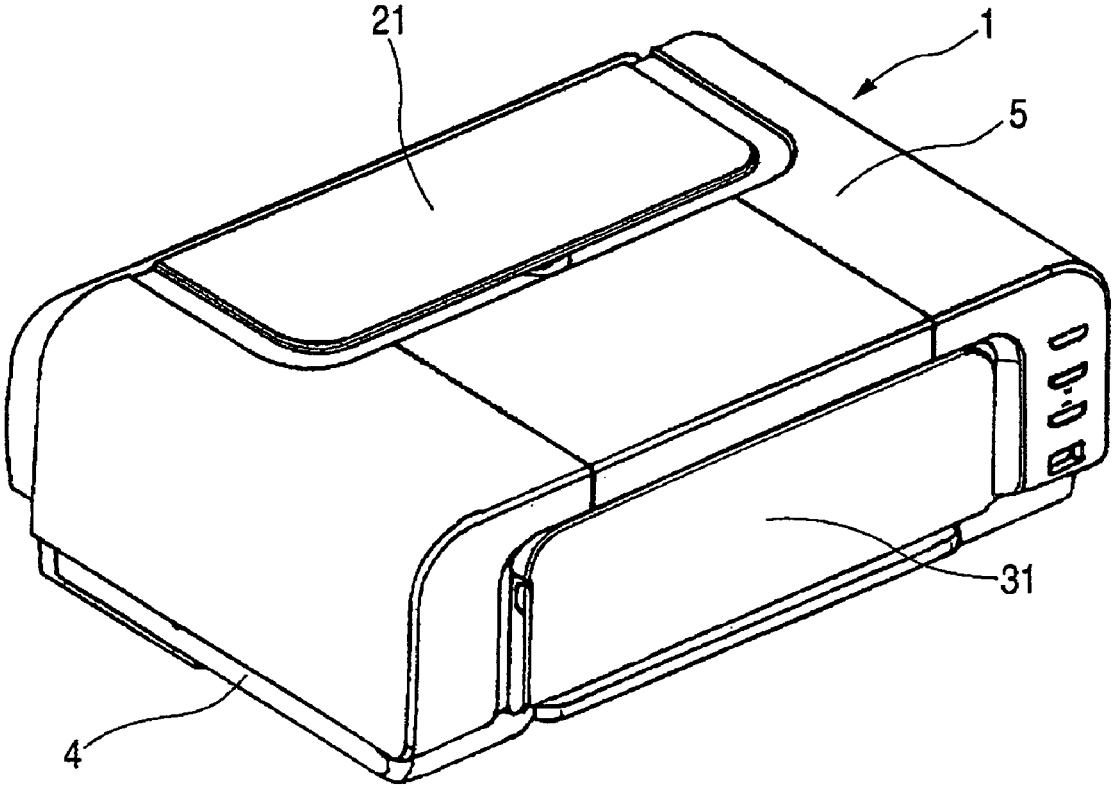
FIG. 2 is an oblique perspective view of the recording apparatus shown in FIG. 1 when the sheet feeding tray and discharge tray are stored within the apparatus.
Figure 3:
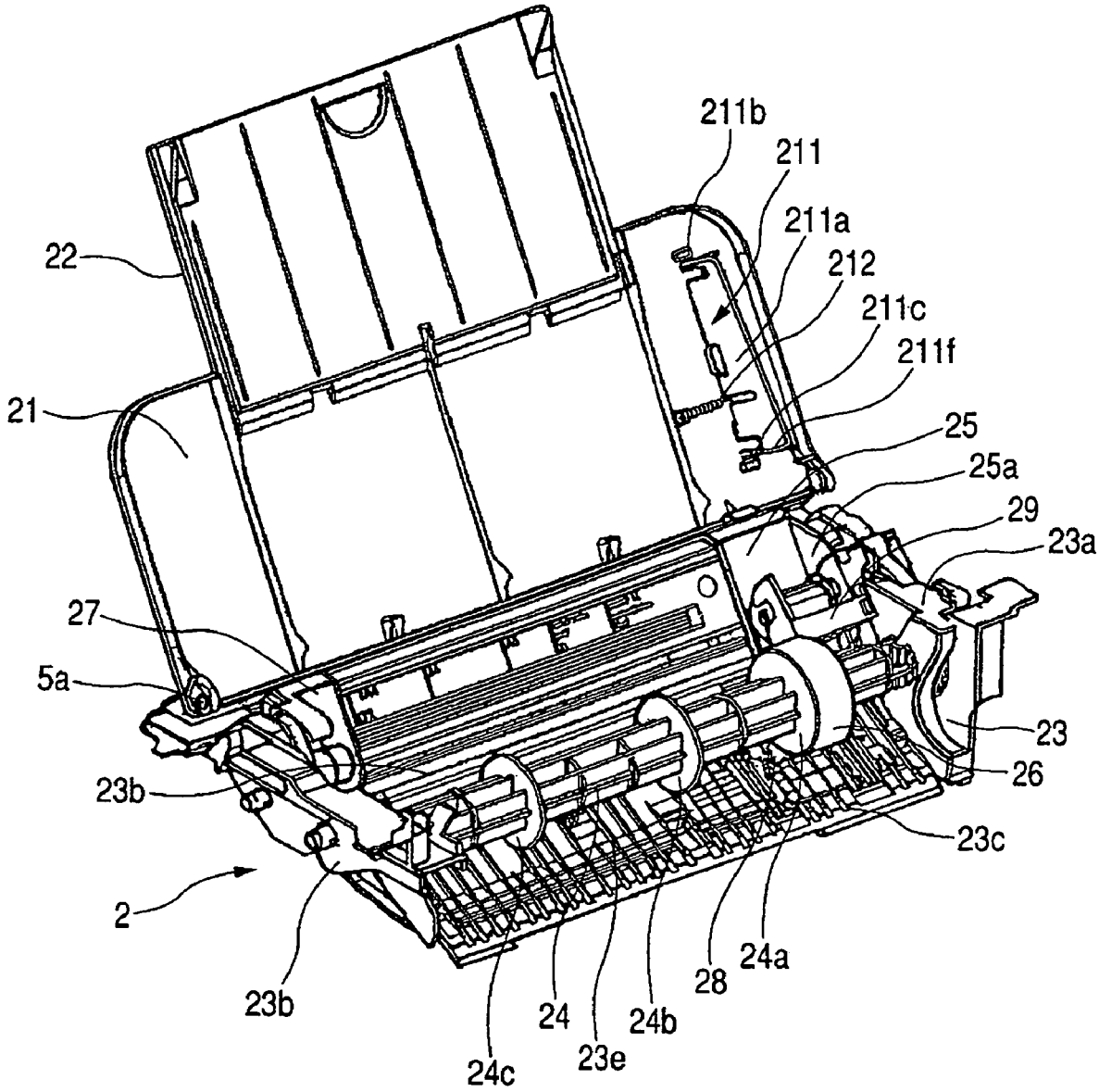
FIG. 3 is an oblique perspective view of the sheet feeding apparatus according to one embodiment when the sheet feeding tray is open.
Figure 4:
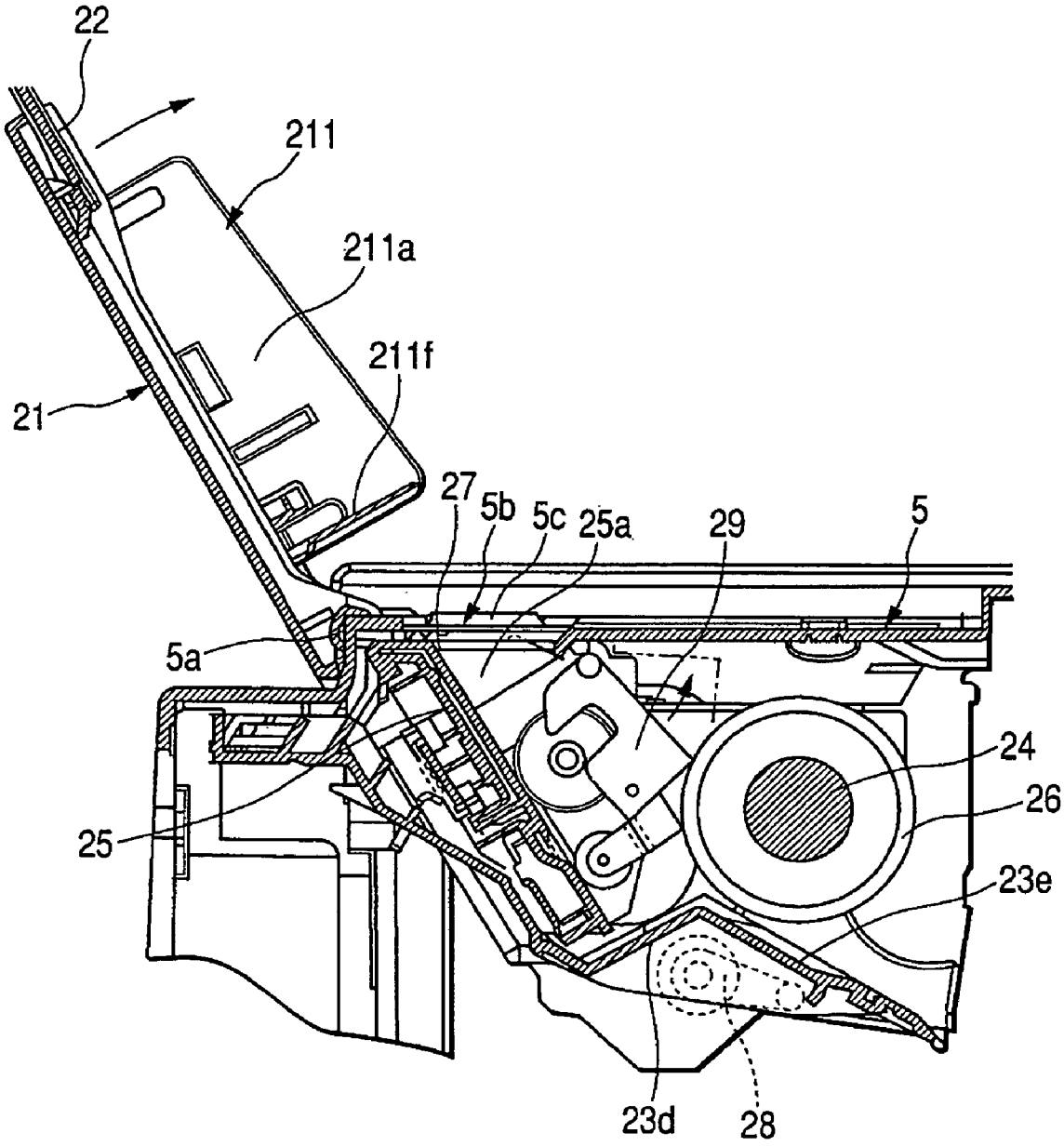
FIG. 4 is a longitudinal section of the sheet feeding apparatus as shown in FIG. 3.

Hereunder, an embodiment of the present invention will be described in detail with reference to the drawings. In each of the drawings, parts that are identical or corresponding are denoted by the same symbols. FIG. 1 is an oblique perspective view of a recording apparatus comprising a sheet feeding apparatus according to an embodiment of this invention in a state in which a sheet feeding tray and a discharge tray are open. FIG. 2 is an oblique perspective view of the recording apparatus shown in FIG. 1 when the sheet feeding tray and discharge tray are stored within the recording apparatus. FIG. 3 is an oblique perspective view of the sheet feeding apparatus according to the embodiment when the sheet feeding tray is open, and FIG. 4 is a longitudinal section of the sheet feeding apparatus as shown in FIG. 3. The sheet feeding apparatus according to the present invention is used for feeding a sheet as a recording medium to an image forming portion in a recording apparatus, and for feeding a sheet as an original to a reading portion in an image reading apparatus. The recording apparatus shown in FIGS. 1 and 2 records an image on a sheet that is fed from a sheet feeding apparatus (sheet feeding portion) by use of a recording head as recording means based on image information. For example, when the recording apparatus is an inkjet recording apparatus, image recording is performed on a sheet by ejecting ink from ejection ports of the recording head based on image information.

In FIG. 1 to FIG. 4, a bundle of sheets S is stacked in a sheet feeding portion 2 that comprises a sheet feeding apparatus, and the sheets are fed one at a time from the uppermost sheet to an image forming portion. A sheet that underwent recording at the image forming portion is discharged from a discharging portion 3 and is stacked and held on a discharge tray 31. The working parts of the sheet feeding portion 2, the image forming portion, and the discharging portion 3 are mounted on a base 4, and these working parts are covered by an external cover 5. The external cover is fixed to the base by a peripheral frame portion thereof. A sheet feeding tray 21 and a discharge tray 31 are respectively provided in the sheet feeding portion 2 and the discharging portion 3. The sheet feeding tray 21 and the discharge tray 31 are supported in a condition whereby they can rotate to open and close around a shaft in the width direction (X direction) of the sheets.

In FIG. 1 and FIG. 3, a support shaft portion (rotation shaft portion) 4*a* and a discharge opening 4*b* of the discharge tray 31 are provided in the base 4, and a support shaft portion (rotation shaft portion) 5*a* and a sheet feed opening 5*b* of the sheet feeding tray 21 are provided in the external cover 5. A sub tray 22 is provided in the sheet feeding tray 21, and a sub tray 32 is provided in the discharge tray 31. The sub tray 22 and the sub tray 32 are configured according to a multi-step slide storage system. FIG. 1 shows a usage state in which the sheet feeding tray and the discharge tray are completely expanded, and FIG. 2 shows a non-usage state in which the sheet feeding tray and the discharge tray are completely stored within the apparatus. In the usage state, the sheet feeding tray and the discharge tray constitute stacking surfaces for sheets. In the non-usage state, the sheet feeding tray covers the sheet feed opening 5*b* and the discharge tray covers the discharge opening 4*b*, such that both trays are stored in the apparatus in a compact condition. The apparatus is configured so that in this stored state, the stacking side of each tray closes in an inward direction, and functionally necessary ribs or projections and depressions and the like are concealed on the underside of the trays.

In FIG. 3, a sheet feeding frame 23 that is the principal structure of the sheet feeding portion 2 has two side portions 23*a* and 23*b*, and a bottom portion 23*c*. The bottom portion 23*c* has a bank portion (a wall surface portion which the leading edges of sheets contact against) 23*d* that supports the top portion of stacked sheets, and a guide portion 23*e* that guides and supports the leading edge of a sheet from the underside when feeding the sheet. The two side portions 23*a* and 23*b* of the sheet feeding frame 23 support a sheet feeding roller shaft 24 such that it can rotate around a shaft in the X direction, and support a pressure plate 25 such that it can oscillate around a shaft in the X direction. Large diameter portions 24*a*, 24*b* and 24*c* are integrally formed at three locations on the sheet feeding roller shaft 24. Among these three locations, a sheet feeding roller rubber 26 interfits with the outer surface of the large diameter portion 24*a* on the right side in FIG. 3 to be fixed thereto. The large diameter portions 24*b* and 24*c* at the other two locations have external diameters that are somewhat smaller than the external diameter of the roller rubber 26, and prevent sheets from rising when they are being fed.

The pressure plate 25 supports the leading edge vicinity of stacked sheets. A vertical wall portion is provided at two side portions of the pressure plate. The pressure plate is also provided with a moveable side guide 27 that can slide in the X direction (sheet width direction). This side guide can be set at an arbitrary position by a lock mechanism and a lock release mechanism. The apparatus can thus support sheets of a variety of sizes. When the movable side guide 27 is used to gather to one side a bundle of sheets stacked on the pressure plate 25, the vertical wall portion on the sheet feeding roller rubber 26 side functions as a sheet positioning portion 25*a*. The position of the sheet positioning portion 25*a* becomes the sheet reference position in the X direction. In addition, movement of the pressure plate 25 in the X direction is restricted by the sheet feeding frame 23, and the pressure plate 25 oscillates at a constant position in a contact clearance direction with respect to the sheet feeding roller (roller rubber) 26.

Rotation operations of the sheet feeding roller shaft 24 and oscillation operations of the pressure plate 25 are controlled by an unshown driving portion. On the underside of the sheet feeding roller rubber 26 is provided a separation portion 28 for pinching the sheet bundle to separate and feed a single sheet. The separation portion is configured so as to be movable between a contact position and a clearance position with respect to the sheet feeding roller rubber 26, and is controlled by an unshown driving portion. A paper type sensor 29 for detecting the type. Of sheet is disposed at a position adjacent to the upstream side of the sheet feeding roller rubber 26 and facing the upper side of the pressure plate 25. This paper type sensor is mounted such that it can move between a withdrawn position in which it is separated from a stacked sheet on the pressure plate so as not to contact therewith, and a reading position in which it lightly contacts against a stacked sheet to detect the gloss level of the sheet surface. The paper type sensor 29 is driven by an unshown driving portion.

Figure 5:
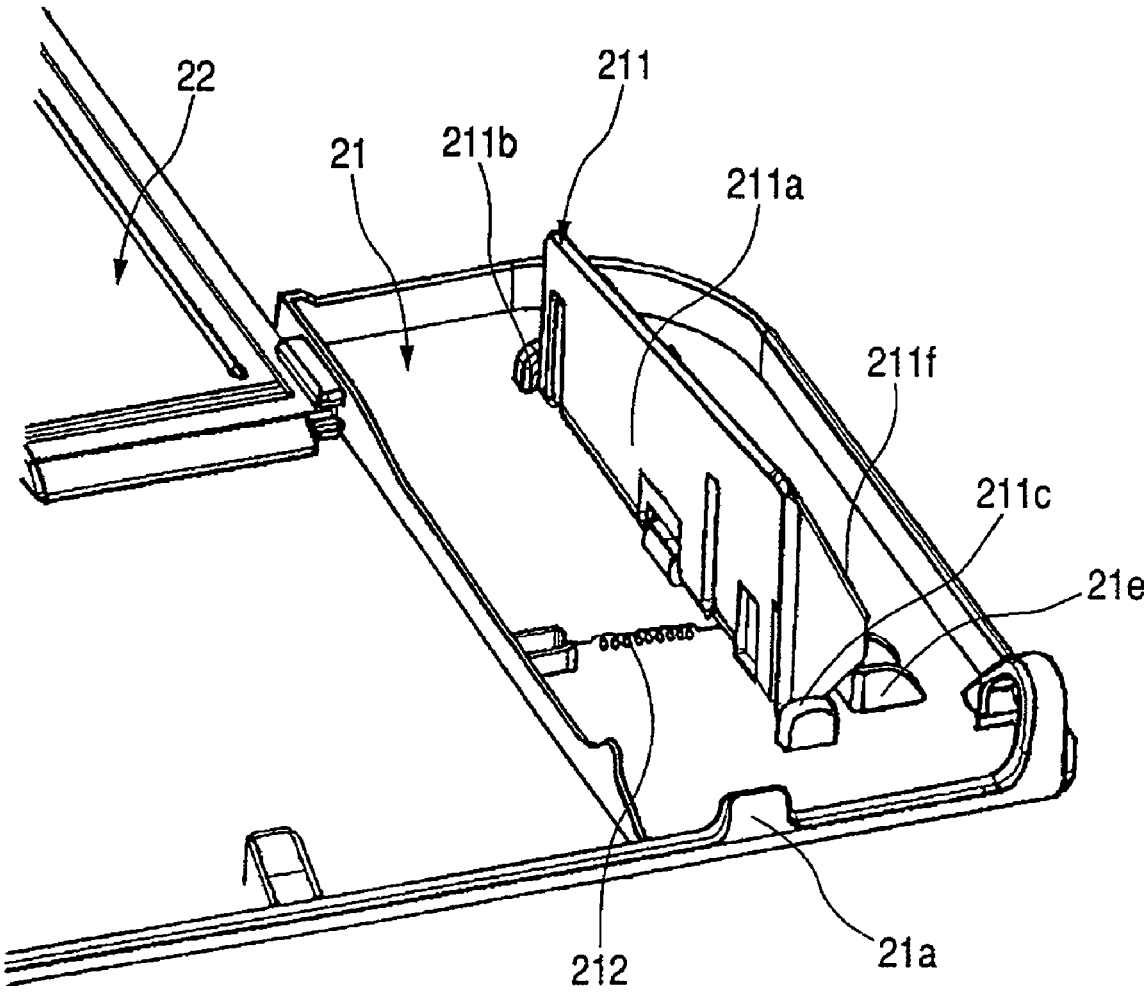
FIG. 5 is a partial perspective view showing a state in which an edge limiting member of the sheet feeding tray of the sheet feeding apparatus according to one embodiment was raised.
Figure 6:
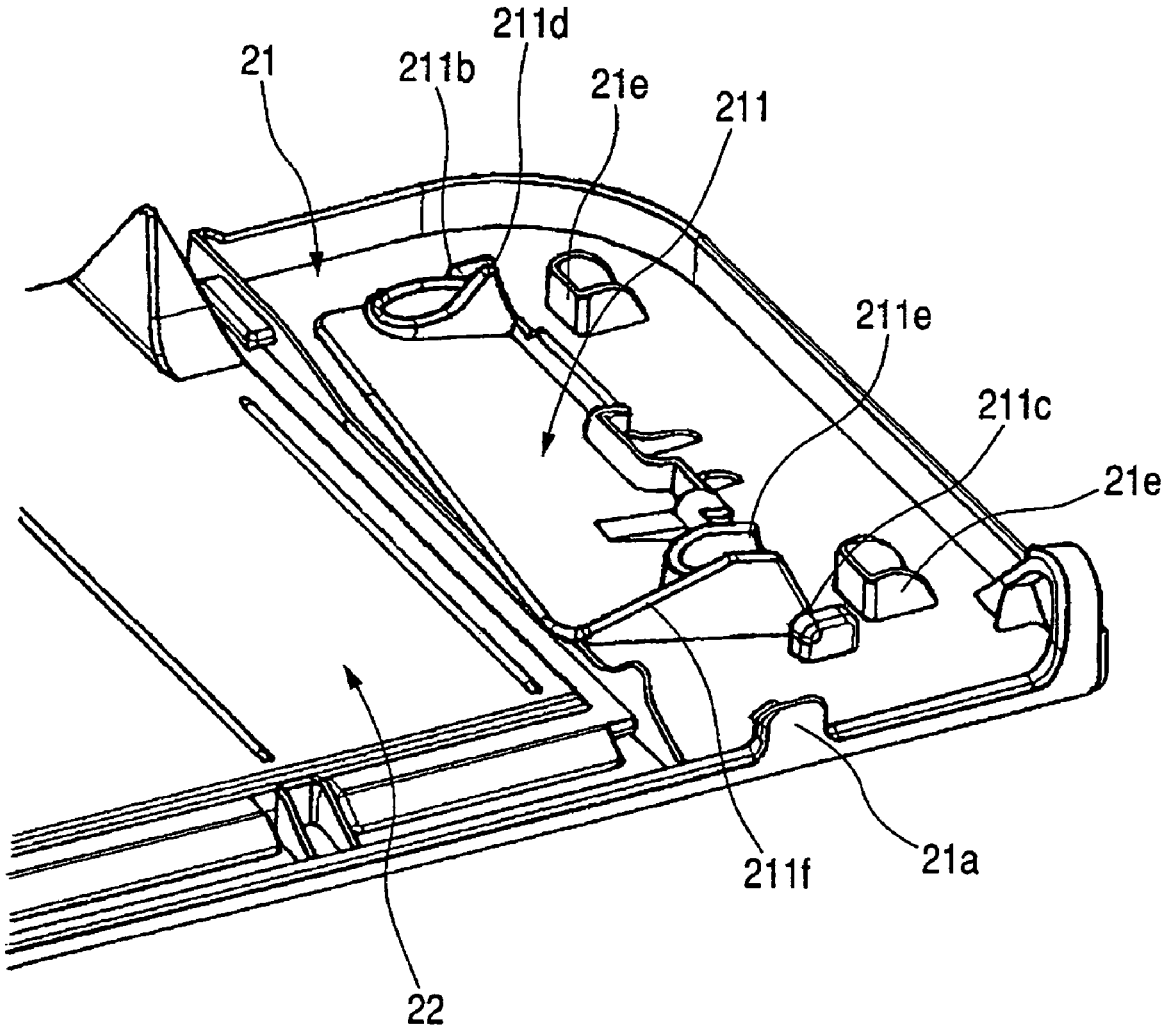
FIG. 6 is a partial perspective view showing a state in which the edge limiting member of the sheet feeding tray shown in FIG. 5 was collapsed.

A foldable edge limiting member 211 is provided at a position in the vicinity of the right side end of the sheet feeding tray 21 as shown in FIG. 1 to FIG. 4. This edge limiting member contacts against the side edge of a bundle of stacked sheets to constitute, together with the sheet positioning portion 25*a*, an edge limiting member that guides the side edges of sheets while limiting the inclination of the sheets as they are being fed. FIG. 5 is a partial perspective view showing a state in which the edge limiting member of the sheet feeding tray of the sheet feeding apparatus according to one embodiment was raised. FIG. 6 is a partial perspective view showing a state in which the edge limiting member of the sheet feeding tray shown in FIG. 5 was collapsed.

Figure 7:
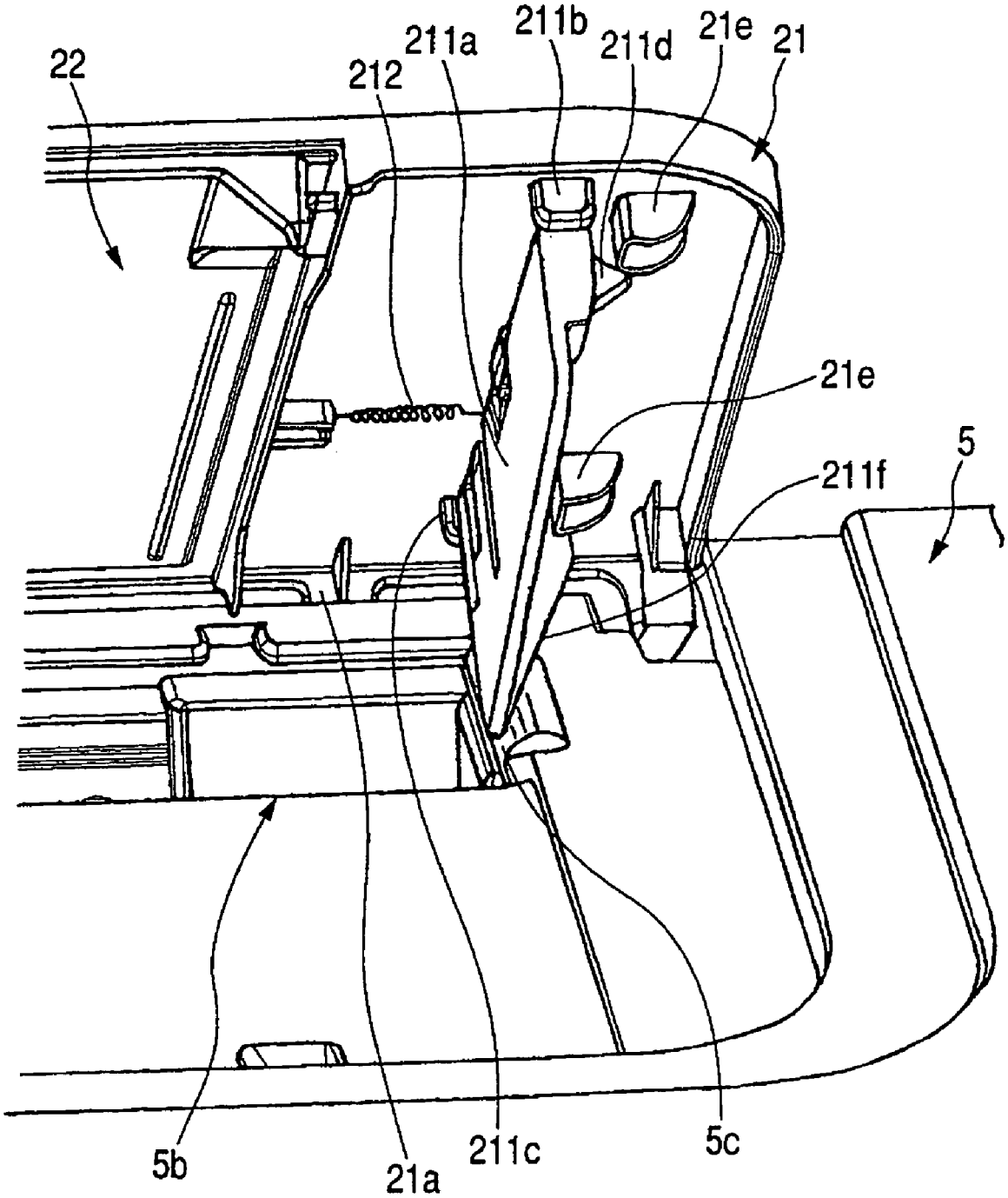
FIG. 7 is an oblique perspective view showing a state in which a top portion of the edge limiting member contacts with a sheet feed opening portion when opening or closing the sheet feeding tray of the sheet feeding apparatus according to one embodiment.
Figure 8:
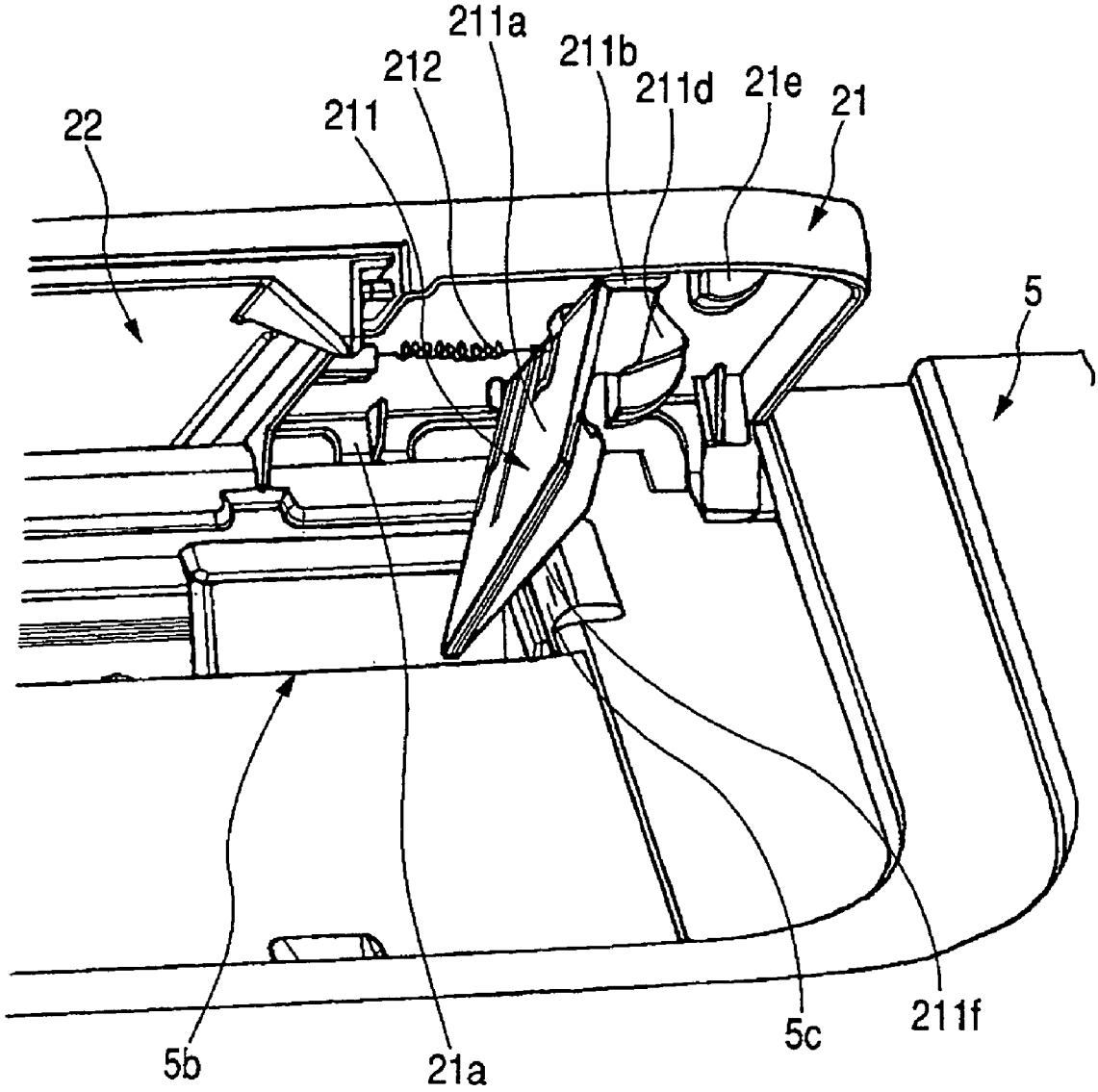
FIG. 8 is an oblique perspective view showing a state in which a cam portion and a sheet feed opening portion contact and slide when opening or closing the sheet feeding tray of the sheet feeding apparatus according to one embodiment.
Figure 9:
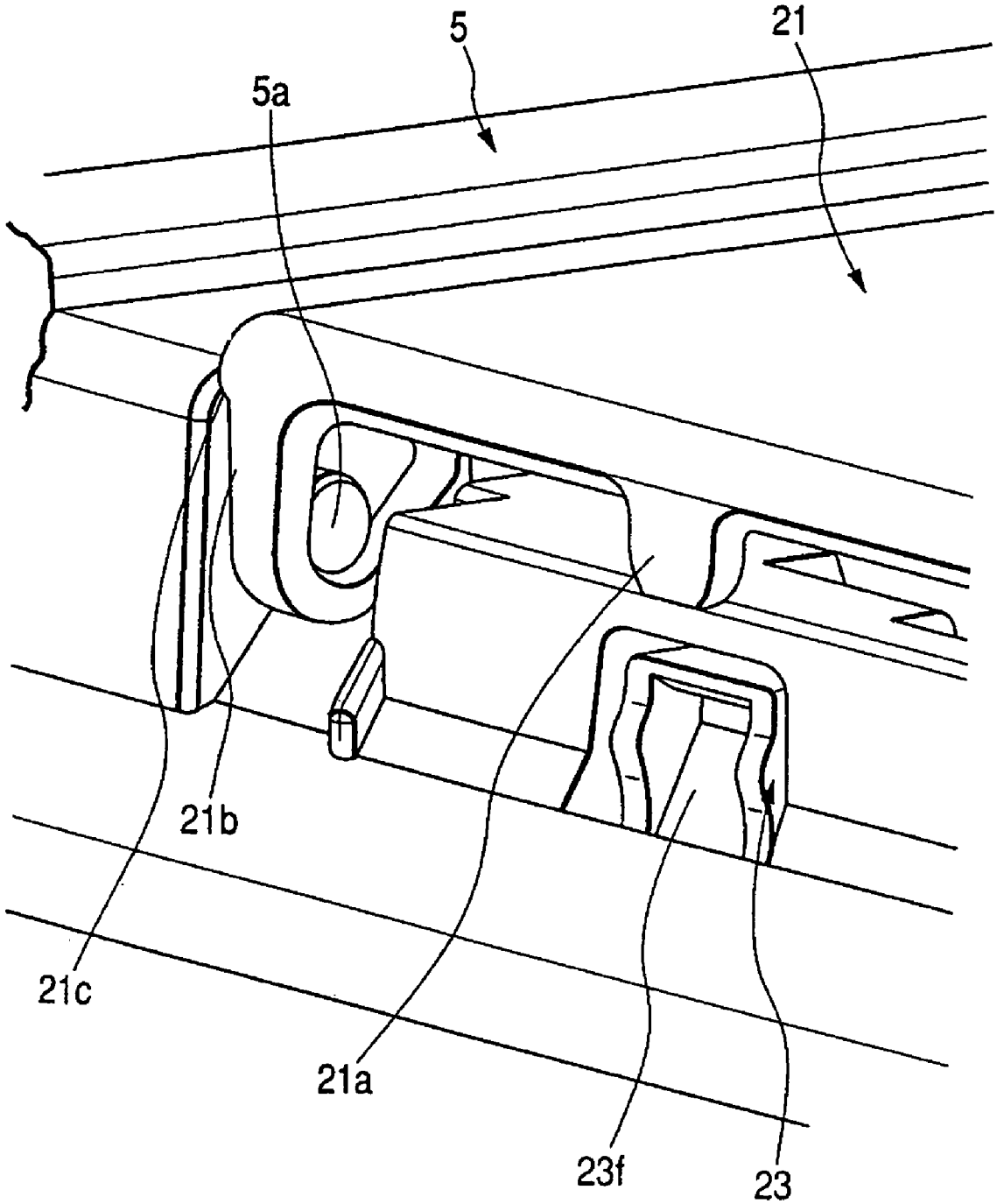
FIG. 9 is a partial perspective view showing a state in which the position of the sheet feeding tray is limited with respect to an external cover in the sheet feeding apparatus according to one embodiment.
Figure 10:
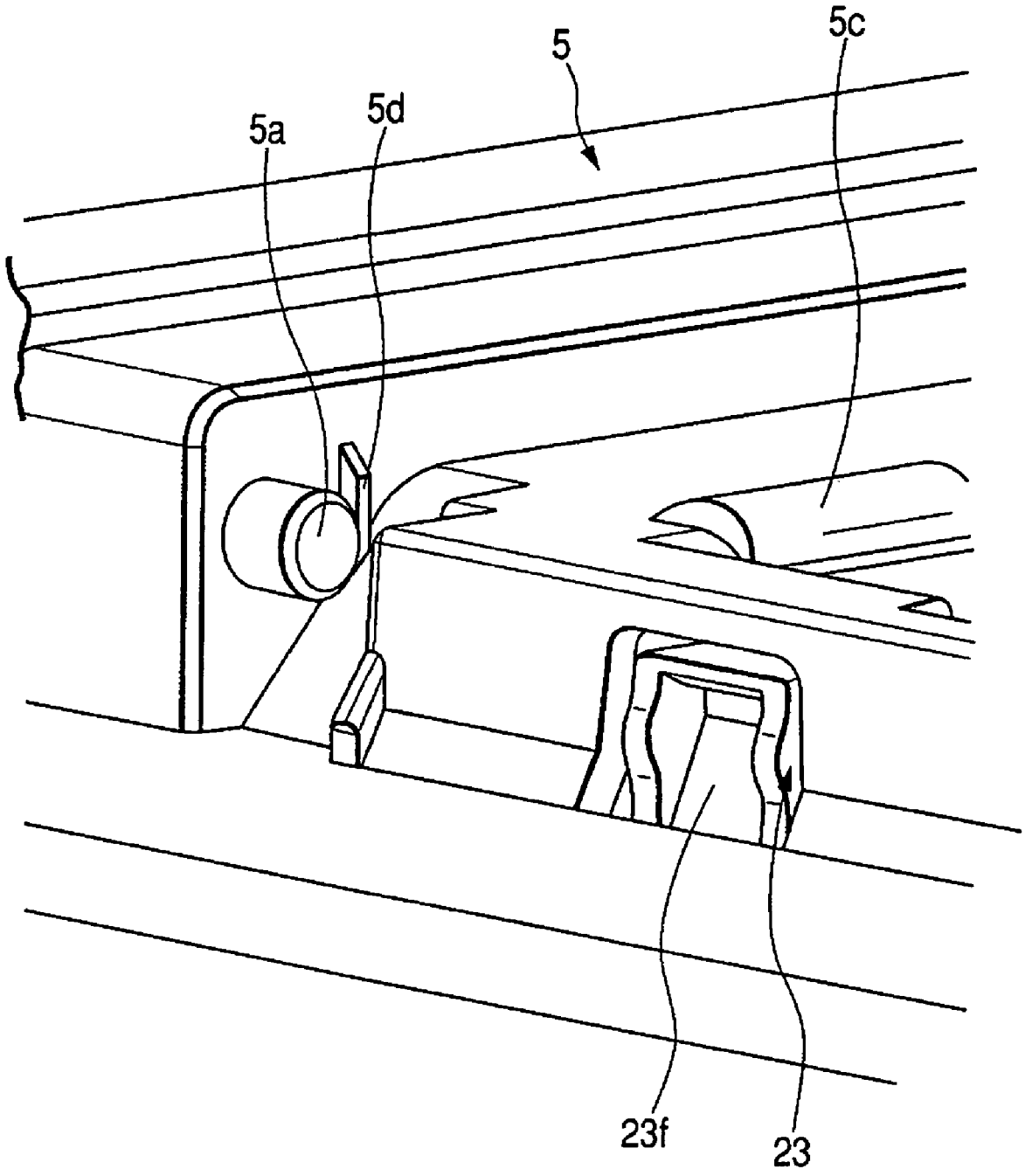
FIG. 10 is a partial perspective view showing a state in which the external cover was removed from the sheet feeding apparatus as shown in FIG. 9.
Figure 11:
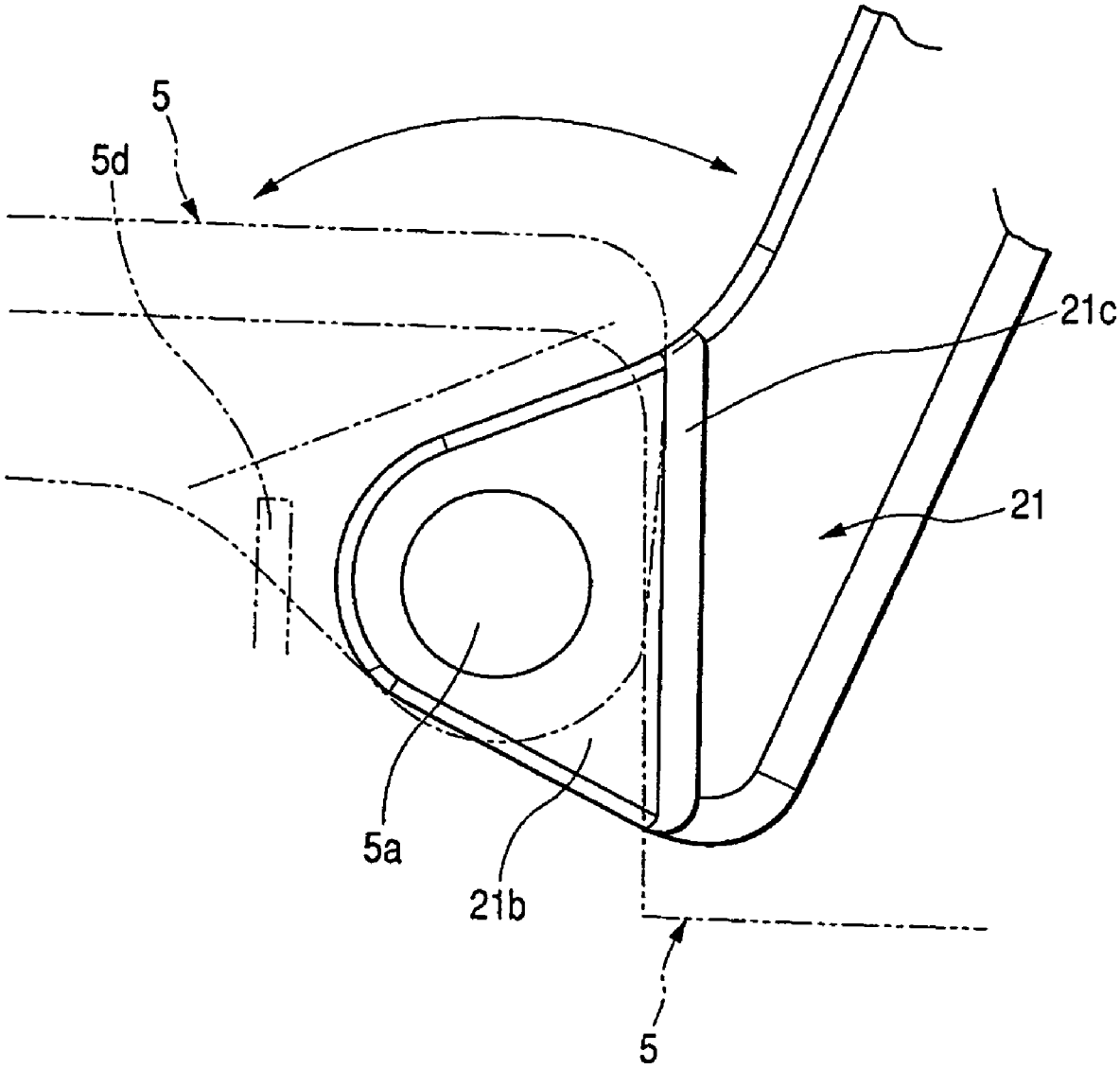
FIG. 11 is a schematic drawing of position limiting means in the sheet width direction as viewed from the shaft, center direction when the sheet feeding tray is open in the sheet feeding apparatus according to one embodiment.
Figure 12:
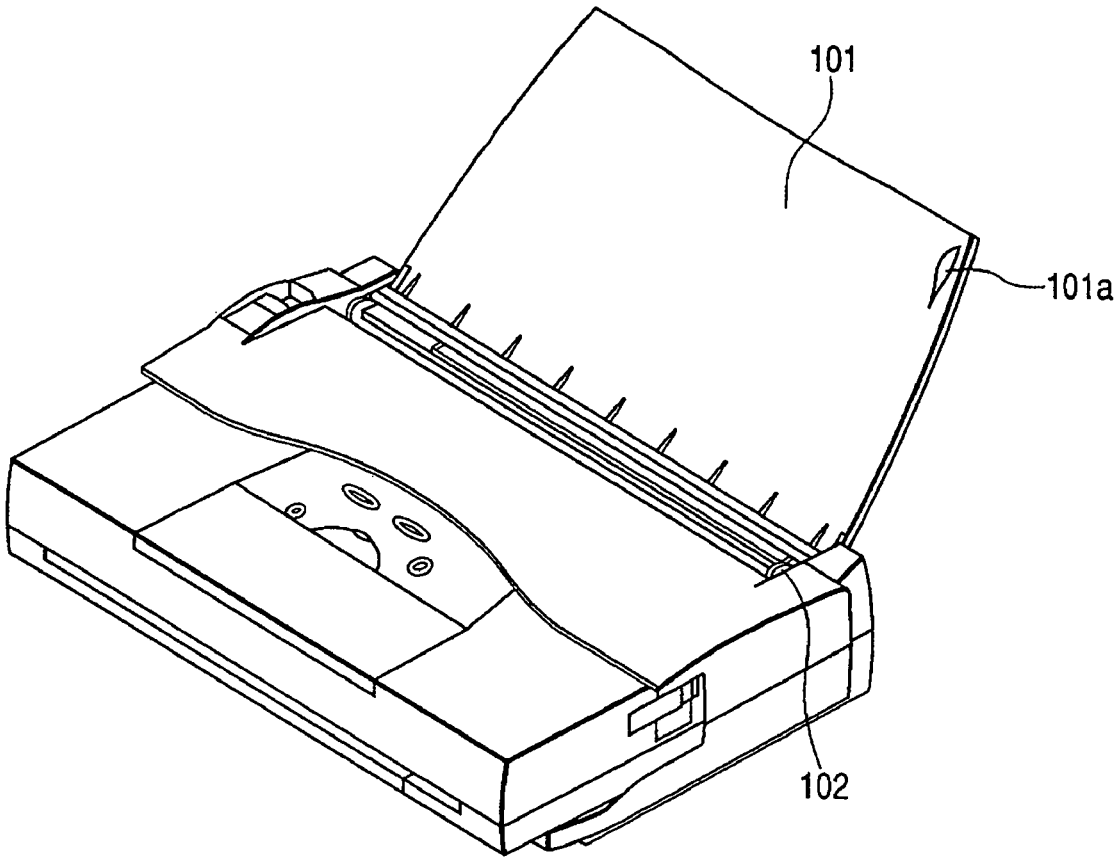
FIG. 12 is an oblique perspective view of a recording apparatus comprising the conventional sheet feeding apparatus in a state in which the sheet feeding tray is open.
Figure 13:
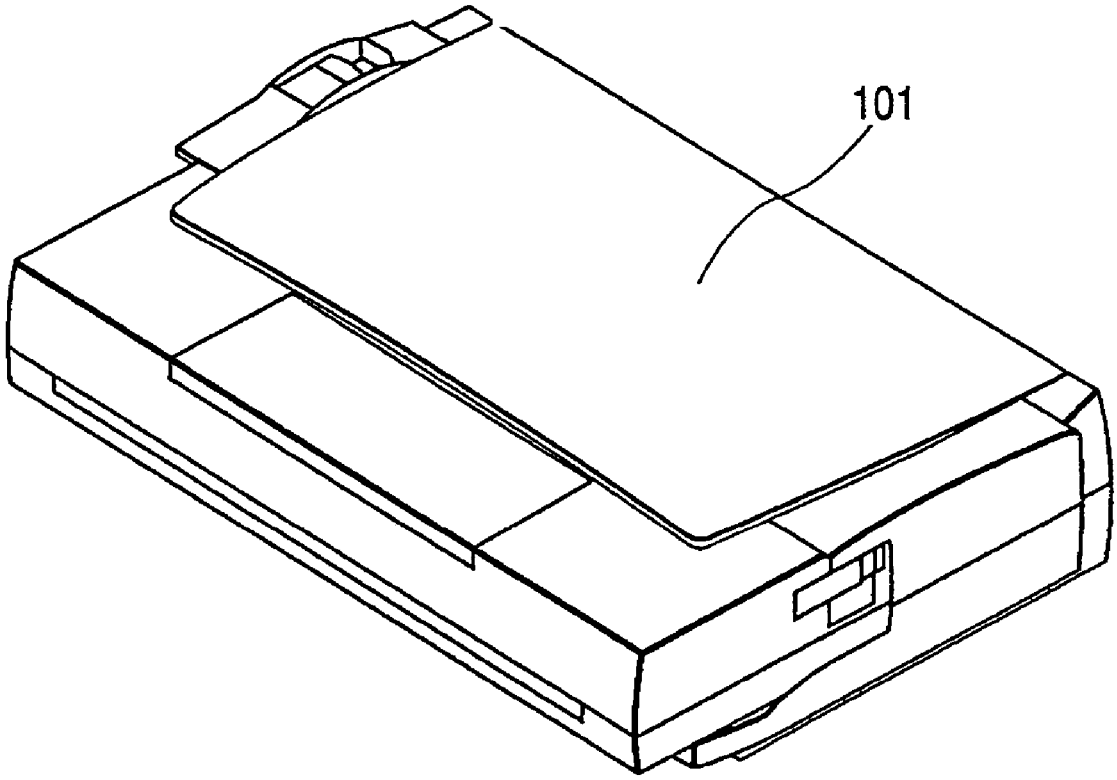
FIG. 13 is an oblique perspective view of the recording apparatus shown in FIG. 12 when the sheet feeding tray is closed.

FIG. 7 is an oblique perspective view showing a state in which a top portion of the edge limiting member contacts with the sheet feed opening portion when opening or closing the sheet feeding tray of the sheet feeding apparatus according to one embodiment. FIG. 8 is an oblique perspective view showing a state in which a cam portion and the sheet feed opening portion contact and slide when opening or closing the sheet feeding tray of the sheet feeding apparatus according to one embodiment. FIG. 9 is a partial perspective view showing a state in which the position of the sheet feeding tray is limited with respect to an external cover in the sheet feeding apparatus according to one embodiment. FIG. 10 is a partial perspective view showing a state in which the external cover was removed from the sheet feeding apparatus as shown in FIG. 9. FIG. 11 is a schematic drawing of position limiting means in the sheet width direction as viewed from the shaft center direction when the sheet feeding tray is open in the sheet feeding apparatus according to one embodiment.

Next, the sheet feeding tray 21 will be described in detail. In FIG. 1 to FIG. 8, the sheet feeding tray 21 is supported in a condition whereby it can open and close by the support shaft portion 5*a* comprising a support shaft in the X direction that is integrally formed in the external cover 5. In the sheet feeding tray 21 are formed a position limiting protrusion portion 21*a* recessed step portions 21*b*, and an inclination guide surface 21*c*. When the sheet feeding tray 21 is closed, a clearance in the X direction between the external cover and the sheet feeding tray becomes a minimal value as the result of a position limiting rib 5*d* that is formed in the external cover 5 being inserted between recessed step portions 21*b* on both sides of the sheet feeding tray. More specifically, when the sheet feeding tray 21 is in a closed state, the position in the sheet width direction of the sheet feeding tray is limited by the position limiting rib 5*d* and the recessed step portions 21*b* as position limiting means and the external cover 5.

According to this width direction position limiting means, by minimizing the clearance between the sheet feeding tray and the external cover, aesthetic characteristics can be enhanced and entry of dust and the like into the sheet feeding portion can be suppressed to a minimum. Further, by limiting the clearance to a minimal value, the aesthetic characteristics and reliability can be improved, as residue of loose powder and the like from components of the apparatus does not come to the surface even when the apparatus is subjected to vibration over a long period during transportation or the like.

When the sheet feeding tray 21 is opened as far as a predetermined position, as shown in FIG. 11, the engagement between the recessed step portions 21*b* and the position limiting rib 5*d* is released and the sheet feeding tray 21 can move by a given amount in the X direction. When the sheet feeding tray 21 is in an open state, the position limiting protrusion portion 21*a* of the sheet feeding tray 21 engages with a position limiting concave portion 23*f* formed in the sheet feeding frame 23. Thereby, movement of the sheet feeding tray 21 in the X direction is limited with respect to the sheet feeding frame 23, and the sheet feeding tray 21 is set at a constant position. More specifically, when the sheet feeding tray 21 is in an open state, the position in the sheet width direction of the sheet feeding tray is limited by the position limiting concave portion 23*f* and the position limiting protrusion portion 21*a* as position limiting means and the sheet feeding portion (sheet feeding frame 23). In addition, at the time of an operation to open or close the sheet feeding tray, the position of the sheet feeding tray 21 can be smoothly altered in the X direction by use of the inclination guide surface of each component, so that it can open and close smoothly.

When the sheet feeding tray 21 is in an open state, the positions in the sheet width direction of the sheet positioning portion 25*a* and the edge limiting member 211 can be directly limited without use of the external cover 5, and thus the position of the sheet feeding tray in the sheet width direction can be limited to a high degree of precision when feeding sheets. It is therefore possible to more surely prevent skewing of sheets at the time of feeding.

The sheet feeding sub tray 22 is provided in a slidable condition in the sheet feeding tray 21. Two positions consisting of a stored position and an extended position can be selected for the sheet feeding sub tray 22. When stacking long-sized sheets, the sheet feeding sub tray 22 is used in an extended state. The edge limiting member 211 of the sheet feeding tray 21 is provided at a sheet reference position. The purpose of the edge limiting member 211 is to prevent skewing of sheets, and it is provided with an edge limiting surface 211*a* that also serves as a sheet inclination limiting surface, rotation shaft portions 211*b* and 211*c* having shaft centers in the front-to-back direction at the lower parts of the front and back ends, rotation stopper portions 211*d* and 211*e* disposed on the rear surface, and a cam portion 211*f* for posture-control that protrudes to the rear surface side at one end.

The edge limiting member 211 is rotationally supported on the sheet feeding tray 21 by the rotation shaft portions 211*b* and 211*c*. The edge limiting member is energized by a torsional coil spring 212 as energizing means such that the edge limiting member 211 is held in a vertical posture (upright position) with respect to the stacking surface of the sheet feeding tray by contact of the rotation stopper portions 211*d* and 211*e* against protrusions 21*e* and 21*e* on the sheet feeding tray 21. More specifically, when the sheet feeding tray 21 is in an open state the edge limiting member is in a vertically upright state and forms substantially the same plane (sheet reference plane) between the edge limiting surface 211*a* and the sheet positioning portion (reference position in the X direction) 25*a* of the pressure plate 25.

When the sheet feeding tray 21 is closed to a predetermined angle, a sheet feed opening portion 5*c* on the sheet reference side of the sheet feed opening 5*b* provided in the external cover 5 contacts against the cam portion 211*f* of the edge limiting member 211. When the sheet feeding tray is rotated further in the closing direction, the edge limiting member is gradually collapsed by a cam action between the sheet feed opening portion and the cam portion. The energizing force of the torsional coil spring 212 that energizes the sheet feeding tray 21 in an upright direction is set to be relatively weak so that the sheet feeding tray can enter a completely closed state by means of its own weight. Further, when the sheet feeding tray is in a closed state (collapsed position), the edge limiting member 211 is collapsed to an angle of roughly 90 degrees (to a substantially flat posture) and is contained between the sheet feeding tray and the external cover 5. At this time, the cam portion 211*f* for controlling the posture of the edge limiting member enters into the sheet feed opening 5*b*. According to this configuration, there is provided control means that moves in response to opening or closing operations of the sheet feeding tray 21 to control the inverted posture of the edge limiting member 211.

Next, sheet feeding operations of the above described sheet feeding apparatus will be described. When the apparatus is on standby, the pressure plate 25 is subjected to position control such that it enters a downward state that is farthest from the sheet feeding roller rubber 26, and the paper type sensor 29 is subjected to position control such that it enters a raised state that is separated from the pressure plate. First, the sheet feeding tray 21 and the discharge tray 31, including the sub trays, are extended as shown in FIG. 1. Next, a bundle of sheets S is stacked on the stacking surface formed by the sheet feeding tray 21, the sub tray 22 and the pressure plate 25, and the movable side guide 27 is adjusted to one side and set in place. One side edge of the stacked sheets is set in a state in which it contacts against the sheet positioning portion 25*a* of the pressure plate as a sheet reference surface and the edge limiting surface 211*a* of the edge limiting member 211.

When a print instruction is received in this usage state, the paper type sensor 29 descends to lightly touch the top of the sheet bundle to determine the type of paper by detecting the degree of surface gloss of the stacked sheets or the like. When detection of the paper type finishes, the paper type sensor withdraws again to a clearance position. The pressure plate 25 then rises and the sheet feeding roller shaft 24 starts rotating, and the separation portion 28 is set in a position it which it presses against the sheet feeding roller rubber 26. Upon contact of the stacked sheets against the sheet feeding roller rubber 26, several of the uppermost sheets of the sheet bundle are delivered forward, and subsequently only the uppermost sheet is separated therefrom and fed by the separation portion 28. The feeding force from the sheet feeding roller rubber 26 near the sheet reference is imparted to the delivered sheet, and a feeding resistance is generated from the path surface (conveying surface) including the guide portion 23*e* of the sheet feeding frame 23.

Since the feeding resistance extends across the whole area in the sheet width, a directional moment occurs during feeding of a sheet due to a balance of force in which the non-reference side of the sheet is delayed. At this time, since the rear edge of the reference side of the sheet that is being fed contacts against the limiting surface 211*a* of the edge limiting member 211 on the sheet feeding tray, a rotational movement in which the rear edge of the sheet moves to the limiting surface side (right side as shown in the figure) is prevented, irrespective of the above described moment. Thus, the sheet can be fed without almost any inclination. According to this embodiment, the length and height of the edge limiting member 211 can be made to structurally adequate dimensions. Accordingly, by making the length and height thereof to adequate dimensions, even in a case in which the size of sheets is short or a large number of sheets are stacked, it is possible to cause the rear edge of the reference side of the sheet that is being fed to contact against the edge limiting surface 211*a*. As a result, skewing of sheets at the time of feeding can be prevented and precise feeding operations can be smoothly performed.

According to the above described embodiment, it is possible to provide the edge limiting member 211 having, a sufficient length and a sufficient height at one side end of sheets with a simple and low-cost configuration without sacrificing operability, space saving or aesthetic characteristics when the sheet feeding tray 21 is in a closed state, or reliability relating to protection of the sheet feeding portion or the like. It is therefore possible to effectively prevent skewing of sheets when performing sheet feeding, even when the size of sheets is short or when a large number of sheets are stacked.

More specifically, since the edge limiting member 211 rotates in response to an operation to open or close the sheet feeding tray 21, operability can be improved. Further, since a configuration is adopted in which the cam portion 211*f* as control means that controls a change in posture of the edge limiting member in response to an opening or closing operation can be contained in a space in the sheet feed opening 21*b*, the cam portion can be configured to be relatively large, and smooth interlocking operations can thus be realized. Furthermore, when the sheet feeding tray is in a closed state, the edge limiting member 211 is collapsed to a substantially 90 degree angle to be contained between the sheet feeding tray and the sheet feeding portion, and the cam portion is also contained in a space in the sheet feed opening 21*b*. Thus, a space saving can be realized. As a result of this space saving, the paper type sensor 29 and the like can be disposed at optimal positions in the sheet feeding portion.

Furthermore, when closing the sheet feeding tray 21, the sheet feeding tray can be properly closed without any interference from the edge limiting member provided in the sheet feeding tray and the sheet positioning portion provided in the sheet feeding portion. It is thereby possible to improve the aesthetic characteristics of the sheet feeding apparatus and to also improve the reliability through protection of the sheet feeding portion. Furthermore, as a whole since a simple and low cost configuration is employed, it is possible to achieve a cost that is low in comparison with the function. Further, since an edge limiting member of a sufficient length and sufficient height can be disposed at one side edge of the sheets, it is possible to effectively prevent skewing of sheets when the sheets are being fed, even when the size of sheets is short or when a large number of sheets are stacked.

When the sheet feeding tray 21 is in an open state, since the configuration directly limits the positions in the sheet width direction of the sheet positioning portion 25*a* of the sheet feeding portion and the edge limiting member 211 of the sheet feeding tray 21 without use of the external cover 5, the position of the sheet feeding tray in the sheet width direction can be limited to a high degree of accuracy. As a result, it is possible to more surely prevent skewing of sheets when feeding the sheets. Further, when the sheet feeding tray is closed, since a position limitation in the sheet width direction with respect to the sheet feeding portion is released and a position limitation in the sheet width direction is performed by the external cover, it is possible to, limit with high precision the opening at the joint between the external cover and the sheet feeding tray to achieve only a small opening. It is thus possible to improve the aesthetic characteristics of the apparatus and also improve reliability relating to protection of the sheet feeding portion from dust and the like.

The above embodiment described an example in which the sheet feeding apparatus according to the present invention was applied to a sheet feeding portion of a recording apparatus that records an image on a sheet by use of recording means (a recording head) on the basis of recording information. However, the sheet feeding apparatus according to the present invention can also be similarly applied to a sheet feeding apparatus that feeds sheets to a reading portion in an image reading apparatus, and a similar action and effect can be expected. Further, a recording apparatus as an object for application of the present invention includes not only a printer but also a printing apparatus, a copier, a facsimile, and a multifunction device or system including these. Furthermore, an applicable recording apparatus may employ any kind of recording system such as an inkjet system, a laser beam system, a thermal transfer system, a thermal system, or a wire dot system.

According to the present invention, there is provided a sheet feeding apparatus comprising a sheet positioning portion that is disposed in a sheet feeding portion such that it can contact against one side edge of stacked sheets, and an edge limiting member that is disposed in a sheet feeding tray such that it can contact against one side edge of stacked sheets at a position that in further upstream than the sheet positioning portion. Since a configuration is adopted whereby the edge limiting member rises together with an operation to open the sheet feeding tray, and the edge limiting member collapses together with an operation to close the sheet feeding tray, a sheet feeding apparatus is provided that can effectively prevent skewing of sheets fed from a sheet feeding tray with a simple and small-size structure.

This application claims priority from Japanese Patent Application No. 2005-191102 filed Jun. 30, 2005, which is hereby incorporated by reference herein.

What is claimed is:

1. A sheet feeding apparatus comprising:

a pressure plate for supporting a sheet and movable between a contact position for contacting a sheet feeding roller and a position separated from the contact position;

a positioning portion that is disposed in the pressure plate and that contacts against a side end of the sheet to limit the position of the side end of the sheet;

a sheet feeding frame for movably supporting said pressure plate;

a sheet feeding tray for supporting the sheet, wherein the sheet feeding tray is openably and closably provided in an apparatus body, the sheet feeding tray supports the sheet when said sheet feeding tray is opened, and the sheet feeding tray faces the pressure plate when said sheet feeding tray is closed;

a limiting member that is disposed in the sheet feeding tray and that limits a position of the side end of the sheet wherein the pressure plate supports a part of the sheet and the sheet feeding tray supports another part of the sheet;

first position limiting means for limiting the position in the sheet width direction of the sheet feeding tray with respect to an external cover when the sheet feeding tray is in a closed state; and second position limiting means for limiting the position in the sheet width direction of the sheet feeding tray with respect to the sheet feeding frame when the sheet feeding tray is in an open state, wherein the first position limiting means does not limit the position of the sheet feeding tray when the sheet feeding tray is opened, wherein the limiting member contacts the sheet with a same side end as the positioning portion contacts, wherein the limiting member contacts a portion of the side end of the sheet upstream from a portion of the side end of the sheet contacted by the positioning portion, and wherein the limiting member rises with respect to the sheet feeding tray in response to an operation to open the sheet feeding tray, and the limiting member collapses in response to an operation to close the sheet feeding tray.

2. The sheet feeding apparatus according to claim 1, wherein when the sheet feeding tray is in a closed state the sheet feeding tray covers a sheet feed opening, and when the sheet feeding tray is in an open state the sheet feeding tray stacks sheets to be fed.

3. The sheet feeding apparatus according to claim 1, wherein when the sheet feeding tray is in a closed state the limiting member is collapsed to an angle of approximately 90 degrees and is stored on a rear surface side of the sheet feeding tray.

4. The sheet feeding apparatus according to claim 1, comprising energizing means that energizes the limiting member in a direction that causes the limiting member to rise, and a stopper that retains the limiting member in a raised position.

5. The sheet feeding apparatus according to claim 1, wherein a posture of the limiting member is altered upon an operation to open or close the sheet feeding tray, by causing a cam portion that is provided on the limiting member to contact against a sheet feed opening portion and slide.

6. The sheet feeding apparatus according to claim 5, wherein when the sheet feeding tray is in a closed state the cam portion fits into a space in the sheet feed opening.

7. The sheet feeding apparatus according to claim 1, wherein the limiting member is disposed at only one of the side ends of a sheet, and a sheet feeding roller that feeds sheets is disposed at a position closer to the center of the width direction of sheets than the limiting member.

8. A recording apparatus that records an image on a sheet, comprising:

recording means for recording an image on a sheet;

a pressure plate for supporting a sheet and movable between a contact position for contacting a sheet feeding roller for feeding the sheet towards the recording means and a position separated from the contact position;

a positioning portion that is disposed in the pressure plate and that contacts against a side end of the sheet to limit the position of the side end of the sheet;

a sheet feeding frame for movably supporting said pressure plate;

a sheet feeding tray wherein the sheet feeding tray is openably and closably provided in an apparatus body, the sheet feeding tray supports the sheet when said sheet feeding tray is opened, and the sheet feeding tray faces the pressure plate when said sheet feeding tray is closed;

a limiting member that is disposed in the sheet feeding tray and that limits a position of the side end of the sheet;

first position limiting means for limiting the position in the sheet width direction of the sheet feeding tray with respect to an external cover when the sheet feeding tray is in a closed state; and second position limiting means for limiting the position in the sheet width direction of the sheet feeding tray with respect to the sheet feeding frame when the sheet feeding tray is in an open state, wherein the first position limiting means does not limit the position of the sheet feeding tray when the sheet feeding tray is opened, wherein the pressure plate supports a part of the sheet and the sheet feeding tray supports another part of the sheet, wherein the limiting member contacts the sheet with a same side end as the positioning portion contacts, wherein the limiting member contacts a portion of the side end of the sheet upstream from a portion of the side end of the sheet contacted by the positioning portion, and wherein the limiting member rises with respect to the sheet feeding tray in response to an operation to open the sheet feeding tray, and the limiting member collapses in response to an operation to close the sheet feeding tray.

9. An image reading apparatus that reads an image on a sheet, comprising:

image reading means for reading an image on a sheet;

a pressure plate for supporting a sheet and movable between a contact position for contacting a sheet feeding roller for feeding the sheet towards the image reading means and a position separated from the contact position;

a positioning portion that is disposed in the pressure plate and that contacts against a side end of the sheet to limit the position of the side end of the sheet;

a sheet feeding frame for movably supporting said pressure plate;

a sheet feeding tray for supporting the sheet, wherein the sheet feeding tray is openably and closably provided in an apparatus body, the sheet feeding tray supports the sheet when said sheet feeding tray is opened, and the sheet feeding tray faces the pressure plate when said sheet feeding tray is closed;

a limiting member that is disposed in the sheet feeding tray and that limits a position of the side end of the sheet;

first position limiting means for limiting the position in the sheet width direction of the sheet feeding tray with respect to an external cover when the sheet feeding tray is in a closed state; and second position limiting means for limiting the position in the sheet width direction of the sheet feeding tray with respect to the sheet feeding frame when the sheet feeding tray is in an open state, wherein the first position limiting means does not limit the position of the sheet feeding tray when the sheet feeding tray is opened, wherein the pressure plate supports a part of the sheet and the sheet feeding tray supports another part of the sheet, wherein the limiting member contacts the sheet with a same side end as the positioning portion contacts, wherein the limiting member contacts a portion of the side end of the sheet upstream from a portion of the side end of the sheet contacted by the positioning portion, and wherein the limiting member rises with respect to the sheet feeding tray in response to an operation to open the sheet feeding tray, and the limiting member collapses in response to an operation to close the sheet feeding tray.

10. A sheet feeding apparatus comprising:

a pressure plate for supporting a sheet and movable between a contact position for contacting a sheet feeding roller and a position separated from said contact position;

a sheet feeding frame for movably supporting said pressure plate;

a sheet feeding tray for supporting the sheet, wherein the sheet feeding tray is openably and closably provided in an apparatus body, the sheet feeding tray supports the sheet when said sheet feeding tray is opened, and the sheet feeding tray faces the pressure plate when said sheet feeding tray is closed;

a limiting member that is disposed in the sheet feeding tray and that limits a position of a side end of the sheet, the limiting member rises with respect to the sheet feeding tray in response to an operation to open the sheet feeding tray, and limiting member collapses in response to an operation to close the sheet feeding tray;

first position limiting means for limiting the position in the sheet width direction of the sheet feeding tray with respect to an external cover when the sheet feeding tray is in a closed state; and second position limiting means for limiting the position in the sheet width direction of the sheet feeding tray with respect to the sheet feeding frame when the sheet feeding tray is in an open state, wherein the first position limiting means does not limit the position of the sheet feeding tray when the sheet feeding tray is opened, wherein the pressure plate supports a part of the sheet and the sheet feeding tray supports another part of the sheet.

11. The sheet feeding apparatus according to claim 1, wherein the first position limiting means comprise recessed portions on the both sides of the sheet feeding tray and ribs formed in the external cover, and each recessed portion engages with one of the ribs to limit the position in the sheet width direction of the sheet feeding tray with respect to an external cover when the sheet feeding tray is in a closed state.

12. The sheet feeding apparatus according to claim 11, wherein the second position limiting means comprise a protrusion portion formed in the sheet feeding tray and a concave portion formed in the sheet feeding frame, wherein the protrusion portion engages with the concave portion to limit the position in the sheet width direction of the sheet feeding tray with respect to the sheet feeding frame and engagement between recessed portions and ribs is released when the sheet feeding tray is in an open state.

* * * * *